US010697404B2

(12) United States Patent
Sheth et al.

(10) Patent No.: US 10,697,404 B2
(45) Date of Patent: Jun. 30, 2020

(54) METHOD AND SYSTEMS FOR AN EGR COOLER INCLUDING COOLING TUBES WITH A COMPLIANT REGION

(71) Applicant: Transportation IP Holdings, LLP, Norwalk, CT (US)

(72) Inventors: Pushkar Haresh Sheth, Bangalore (IN); John Patrick Dowell, Grove City, PA (US); Jayesh Jain, Bangalore (IN); Eric David Peters, Erie, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 16/375,623

(22) Filed: Apr. 4, 2019

(65) Prior Publication Data

US 2019/0234351 A1 Aug. 1, 2019

Related U.S. Application Data

(62) Division of application No. 15/077,287, filed on Mar. 22, 2016, now Pat. No. 10,302,047.

(51) Int. Cl.

| | |
|---|---|
| ***F02M 26/29*** | (2016.01) |
| ***F28D 1/053*** | (2006.01) |
| ***F28D 7/16*** | (2006.01) |
| ***F28F 1/00*** | (2006.01) |
| ***F28F 1/08*** | (2006.01) |
| ***F02M 26/32*** | (2016.01) |
| ***B21D 53/08*** | (2006.01) |
| ***B21D 41/02*** | (2006.01) |

(Continued)

(52) U.S. Cl.

CPC ..... *F02M 26/29* (2016.02); *B21D 41/028* (2013.01); *B21D 53/085* (2013.01); *F02M 26/32* (2016.02); *F28D 1/05316* (2013.01); *F28D 1/05366* (2013.01); *F28D 7/16* (2013.01); *F28D 7/1615* (2013.01); *F28F 1/006* (2013.01); *F28F 1/08* (2013.01); *F02M 26/02* (2016.02); *F02M 26/11* (2016.02); *F02M 26/28* (2016.02); *F28F 2265/26* (2013.01); *F28F 2275/125* (2013.01)

(58) Field of Classification Search

CPC ..... F02M 26/29; B21D 41/028

See application file for complete search history.

(56) References Cited

U.S. PATENT DOCUMENTS 3,773,087 A * 11/1973 Katayama ..... F16L 51/027 138/120

4,276,929 A * 7/1981 Howard ..... F28D 21/0008 165/145

(Continued)

*Primary Examiner* — Joseph J Dallo

*Assistant Examiner* — Kurt Philip Liethen

(74) *Attorney, Agent, or Firm* — McCoy Russell LLP

(57) ABSTRACT

Various methods and systems are provided for an exhaust gas recirculation cooler including a plurality of cooling tubes. In one example, an exhaust gas recirculation (EGR) cooler includes a plurality of cooling tubes positioned within a housing of the EGR cooler, each cooling tube of the plurality of cooling tubes extending between and directly coupled to tube sheets of the EGR cooler at ends of each cooling tube, where at least one end of one or more cooling tubes of a first portion of the plurality of cooling tubes, inward of a tube sheet coupled to the at least one end, includes a compliant region, where the first portion is positioned proximate to an exhaust inlet of the EGR cooler.

20 Claims, 6 Drawing Sheets

(51) Int. Cl.

| | |
|---|---|
| ***F02M 26/02*** | (2016.01) |
| ***F02M 26/11*** | (2016.01) |
| ***F02M 26/28*** | (2016.01) |

(56) References Cited

U.S. PATENT DOCUMENTS

| | | | | |
|---|---|---|---|---|
| 4,289,198 | A * | 9/1981 | Young | F28F 9/22 165/159 |
| 4,597,687 | A | 7/1986 | Colas | |
| 6,062,266 | A * | 5/2000 | Burkhardt | F01N 13/14 138/114 |
| 6,119,665 | A | 9/2000 | Anderson et al. | |
| 9,062,634 | B1 * | 6/2015 | Wu | F28F 9/02 |
| 2003/0089491 | A1 * | 5/2003 | Mitsumoto | B01J 8/067 165/157 |
| 2005/0098307 | A1 * | 5/2005 | Goto | F28D 7/1615 165/146 |
| 2006/0144585 | A1 * | 7/2006 | Ha | F01N 3/043 126/307 R |
| 2008/0011456 | A1 | 1/2008 | Meshenky | |
| 2013/0105127 | A1 | 5/2013 | Postma et al. | |
| 2014/0298874 | A1 * | 10/2014 | Maggiolo | B21D 53/085 72/43 |
| 2016/0326997 | A1 | 11/2016 | Gottemoller et al. | |

* cited by examiner

METHOD AND SYSTEMS FOR AN EGR COOLER INCLUDING COOLING TUBES WITH A COMPLIANT REGION

CROSS-REFERENCE TO RELATED APPLICATIONS

The present application is a divisional of U.S. Non-Provisional patent application Ser. No. 15/077,287, entitled "METHOD AND SYSTEMS FOR AN EGR COOLER INCLUDING COOLING TUBES WITH A COMPLIANT REGION", and filed on Mar. 22, 2016. The entire contents of the above-listed application are hereby incorporated by reference for all purposes.

BACKGROUND

Technical Field

Embodiments of the subject matter disclosed herein relate to an exhaust gas recirculation (EGR) system, a cooler for that system, and associated methods.

Discussion of Art

Engines may utilize recirculation of exhaust gas from an engine exhaust system to an engine intake system, a process referred to as exhaust gas recirculation (EGR). In some examples, a group of one or more cylinders may have an exhaust manifold that is coupled to an intake passage of the engine such that the group of cylinders is dedicated, at least under some conditions, to generating exhaust gas for EGR. Such cylinders may be referred to as "donor cylinders." In other systems, the exhaust gas may be pulled from a manifold.

Some EGR systems may include an EGR cooler to reduce a temperature of the recirculated exhaust gas before it enters the intake passage. The exhaust gas recirculation (EGR) cooler may be used to reduce exhaust gas temperature from about 1000 degrees Fahrenheit to about 200 degrees Fahrenheit. Some EGR coolers may fail during use due to high stress concentration in cooling tubes at a connection point between the cooling tubes and a tube sheet of the EGR cooler. Compressive forces may act on the cooling tubes due to constraints on ends of the cooling tubes by a sidewall of a housing of the EGR cooler, thereby resulting in degradation of the tube-tube sheet joint. Stress concentrations on the tubes may be greatest at a leading edge of the EGR cooler, the edge that is closest to an exhaust inlet of the EGR cooler, due to increased thermal gradients at this location.

BRIEF DESCRIPTION

In one embodiment, an exhaust gas recirculation (EGR) cooler comprises a plurality of cooling tubes positioned within a housing of the EGR cooler. Each cooling tube of the plurality of cooling tubes extends between and is directly coupled to tube sheets of the EGR cooler at ends of each cooling tube. At least one end of one or more cooling tubes of a first portion of the plurality of cooling tubes, inward of a tube sheet coupled to the at least one end, includes a compliant region, where the first portion is positioned proximate to an exhaust inlet of the EGR cooler.

DETAILED DESCRIPTION

Figure 1:
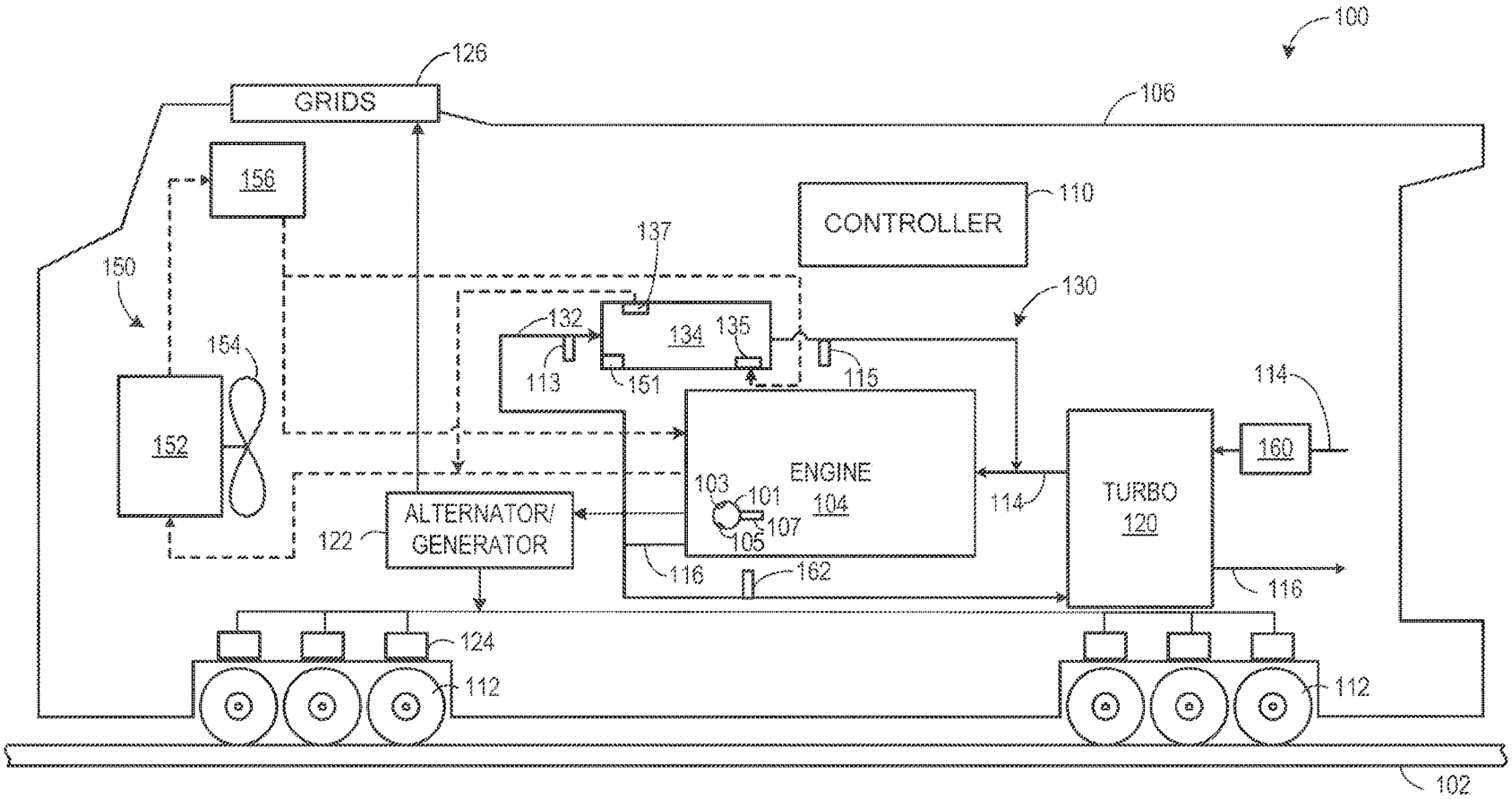
FIG. 1 shows a schematic diagram of a vehicle with an engine and an exhaust gas recirculation (EGR) cooler according to an embodiment of the invention.
Figure 2:
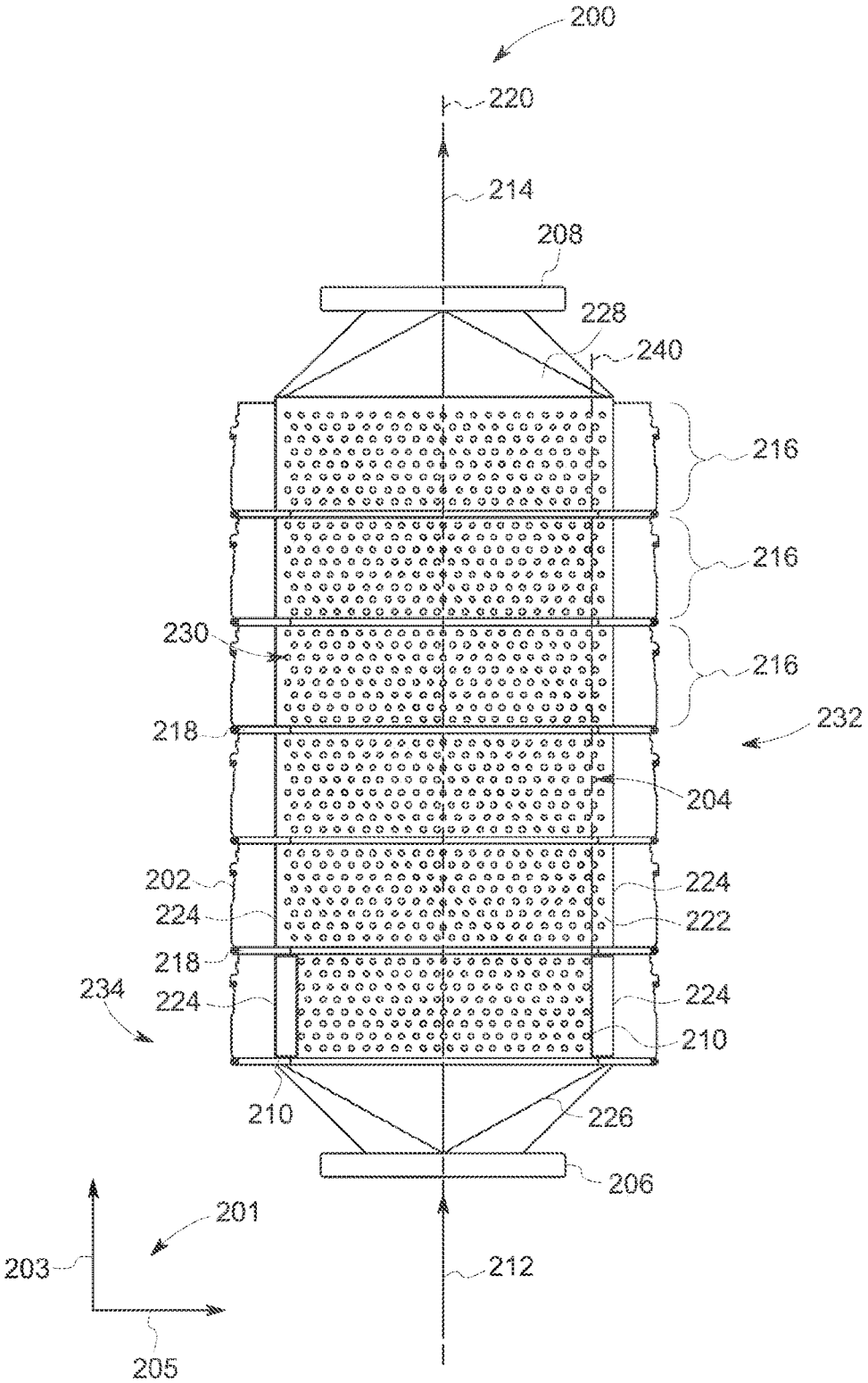
FIG. 2 shows a schematic illustration of an EGR cooler system according to an embodiment of the invention.
Figure 3:
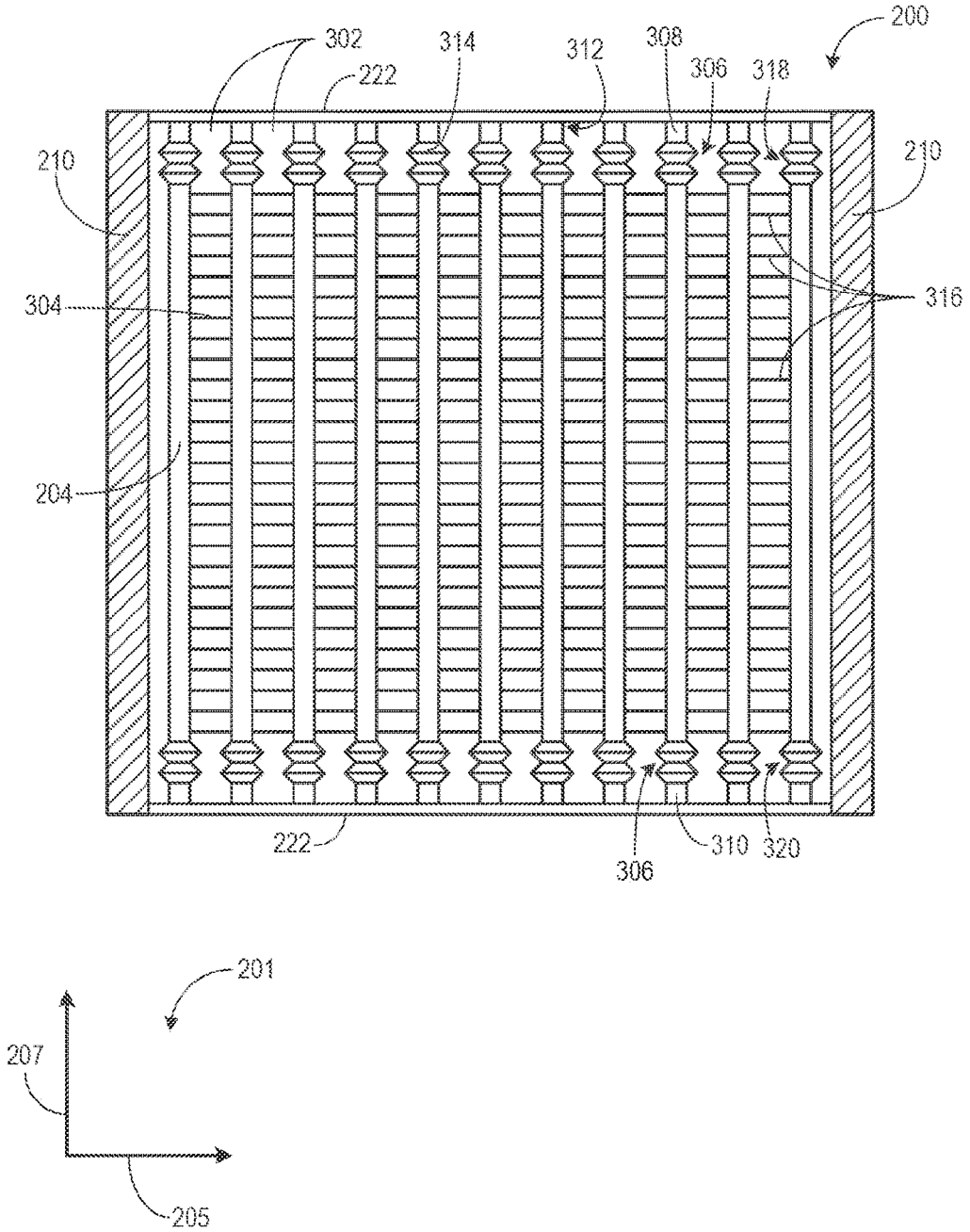
FIG. 3 shows a cross-sectional front view of an EGR cooler including one or more cooling tubes with a compliant region according to an embodiment of the invention.
Figure 4:
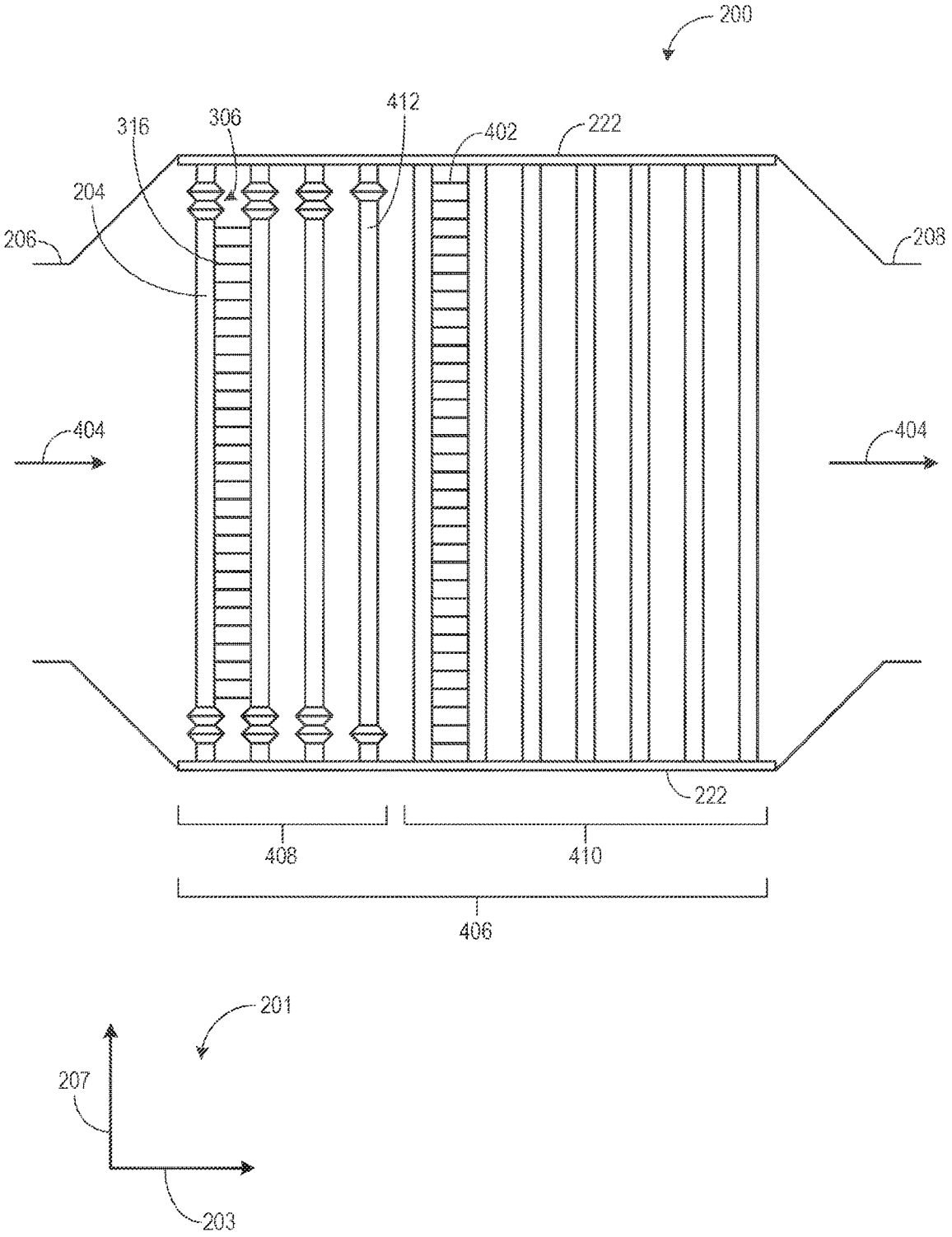
FIG. 4 shows a cross-sectional side view of an EGR cooler including one or more cooling tubes with a compliant region according to an embodiment of the invention.
Figure 5:
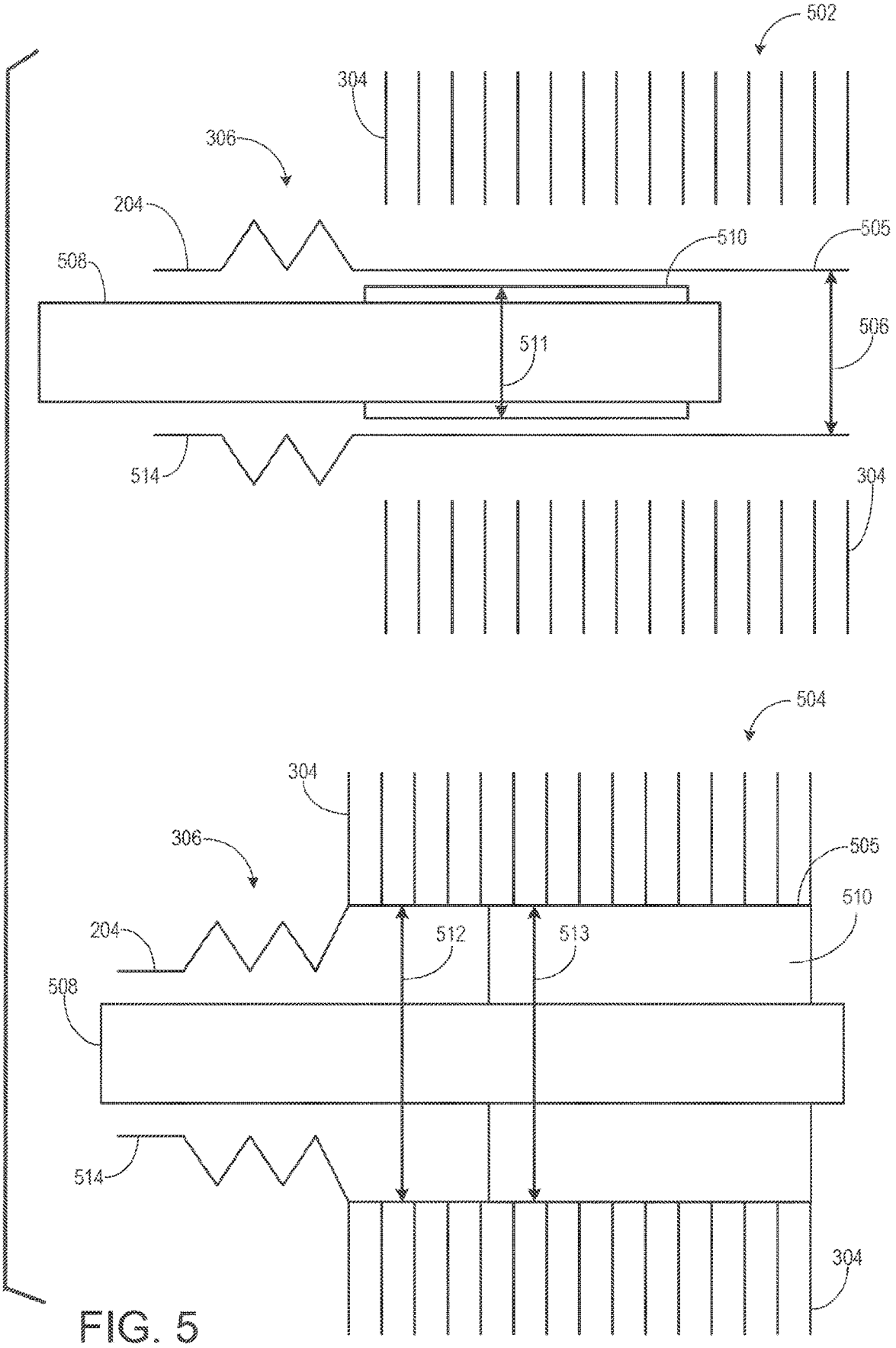
FIG. 5 shows a schematic illustration of a process for expanding cooling tubes within an EGR cooler according to an embodiment of the invention.

One or more embodiments of the inventive subject matter described herein are directed to a system that includes exhaust gas recirculation (EGR), and an EGR cooler as part of that system, such as the engine system shown in FIG. 1. An engine generates exhaust and a portion of that exhaust is directed to an air intake for the engine, prior to mixing the exhaust gas with the intake air, the exhaust gas is cooled in the EGR cooler. Embodiments of the EGR cooler are shown in FIGS. 2-4. As shown in FIGS. 2-4, one or more cooling tubes of the EGR cooler may include a compliant region inward of a tube-tube sheet junction. In one example, the compliant region may include a plurality of corrugations. Due to the corrugations, a process for expanding the cooling tubes within the EGR cooler to interface with fins of the EGR cooler (during manufacturing of the EGR cooler) may include expanding the tubes only in a region of the tubes not including the compliant region using an expanding mandrel, as shown in the schematic of FIG. 5 and method presented in FIG. 6.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

FIG. 1 shows an embodiment of a system in which an EGR cooler may be installed. Specifically, FIG. 1 shows a block diagram of an embodiment of a vehicle system 100, herein depicted as a rail vehicle 106 (e.g., locomotive), configured to run on a rail 102 via a plurality of wheels 112. As depicted, the rail vehicle includes an engine 104. The engine includes a plurality of cylinders 101 (only one representative cylinder shown in FIG. 1) that each include at least one intake valve 103, exhaust valve 105, and fuel injector 107. Each intake valve, exhaust valve, and fuel injector may include an actuator that is actuatable via a signal from a controller 110 of the engine. In other non-limiting embodiments, the engine may be a stationary engine, such as in a power-plant application, or an engine in a marine vessel or other off-highway vehicle propulsion system as noted above. Further, in some embodiments, the plurality of cylinder may include a first group of donor cylinders and a second group of non-donor cylinders, where the donor cylinder supply exhaust to an exhaust gas recirculation (EGR) passage routing exhaust back to the intake of the engine, as explained further below.

The engine receives intake air for combustion from an intake passage 114. The intake passage receives ambient air from an air filter 160 that filters air from outside of the rail vehicle. Exhaust gas resulting from combustion in the engine is supplied to an exhaust passage 116. Exhaust gas flows through the exhaust passage, and out of an exhaust stack of the rail vehicle. In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally combust fuel including gasoline, kerosene, natural gas, biodiesel, or other petroleum distillates of similar density through compression ignition (and/or spark ignition).

In one embodiment, the rail vehicle is a diesel-electric vehicle. As depicted in FIG. 1, the engine is coupled to an electric power generation system, which includes an alternator/generator 122 and electric traction motors 124. For example, the engine is a diesel and/or natural gas engine that generates a torque output that is transmitted to the alternator/generator which is mechanically coupled to the engine. In one embodiment herein, the engine is a multi-fuel engine operating with diesel fuel and natural gas, but in other examples the engine may use various combinations of fuels other than diesel and natural gas.

The alternator/generator produces electrical power that may be stored and applied for subsequent propagation to a variety of downstream electrical components. As an example, the alternator/generator may be electrically coupled to a plurality of traction motors and the alternator/generator may provide electrical power to the plurality of traction motors. As depicted, the plurality of traction motors are each connected to one of the plurality of wheels to provide tractive power to propel the rail vehicle. One example configuration includes one traction motor per wheel set. As depicted herein, six traction motors correspond to each of six pairs of motive wheels of the rail vehicle. In another example, alternator/generator may be coupled to one or more resistive grids 126. The resistive grids may be configured to dissipate excess engine torque via heat produced by the grids from electricity generated by alternator/generator.

In some embodiments, the vehicle system may include a turbocharger 120 that is arranged between the intake passage and the exhaust passage. The turbocharger increases air charge of ambient air drawn into the intake passage in order to provide greater charge density during combustion to increase power output and/or engine-operating efficiency. The turbocharger may include a compressor (not shown) which is at least partially driven by a turbine (not shown). While in this case a single turbocharger is included, the system may include multiple turbine and/or compressor stages. Additionally or alternatively, in some embodiments, a supercharger may be present to compress the intake air via a compressor driven by a motor or the engine, for example. Further, in some embodiments, a charge air cooler (e.g., water-based intercooler) may be present between the compressor of the turbocharger or supercharger and intake manifold of the engine. The charge air cooler may cool the compressed air to further increase the density of the charge air.

In some embodiments, the vehicle system may further include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, $NO_x$ trap, or various other devices or systems.

The vehicle system may further include an exhaust gas recirculation (EGR) system 130 coupled to the engine, which routes exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). As depicted in FIG. 1, the EGR system includes an EGR passage 132 and an EGR cooler 134 to reduce the temperature of the exhaust gas before it enters the intake passage. By introducing exhaust gas to the engine, the amount of available oxygen for combustion is decreased, thereby reducing the combustion flame temperatures and reducing the formation of nitrogen oxides (e.g., $NO_x$). Additionally, the EGR system may include one or more sensors for measuring temperature and pressure of the exhaust gas flowing into and out of the EGR cooler. For example, there may be a temperature and/or pressure sensor 113 positioned upstream of the EGR cooler (e.g., at the exhaust inlet of the EGR cooler) and a temperature and/or pressure sensor 115 positioned downstream of the EGR cooler (e.g., at the exhaust outlet of the EGR cooler). In this way, the controller may measure a temperature and pressure at both the exhaust inlet and outlet of the EGR cooler. The EGR cooler may further include a fouling sensor 151 for detecting an amount of fouling (e.g., deposits built-up on the cooling tubes in the exhaust passages) within an interior of the EGR cooler. In this way, the controller may directly measure a level (e.g., amount or percentage) of fouling of the EGR cooler.

In some embodiments, the EGR system may further include an EGR valve for controlling an amount of exhaust gas that is recirculated from the exhaust passage of the engine to the intake passage of the engine. The EGR valve may be an on/off valve controlled by a controller 110, or it may control a variable amount of EGR, for example. As shown in the non-limiting example embodiment of FIG. 1, the EGR system is a high-pressure EGR system. In other embodiments, the vehicle system may additionally or alternatively include a low-pressure EGR system, routing EGR from downstream of the turbine to upstream of the compressor.

As depicted in FIG. 1, the vehicle system further includes a cooling system 150 (e.g., engine cooling system). The cooling system circulates coolant through the engine to absorb waste engine heat and distribute the heated coolant to a heat exchanger, such as a radiator 152 (e.g., radiator heat exchanger). In one example, the coolant may be water. A fan 154 may be coupled to the radiator in order to maintain an airflow through the radiator when the vehicle is moving slowly or stopped while the engine is running. In some examples, fan speed may be controlled by the controller. Coolant which is cooled by the radiator may enter a tank (not shown). The coolant may then be pumped by a water, or coolant, pump 156 back to the engine or to another component of the vehicle system, such as the EGR cooler and/or charge air cooler.

As shown in FIG. 1, a coolant/water passage from the pump splits in order to pump coolant (e.g., water) to both the EGR cooler and engine in parallel. In one example, as shown in FIG. 1, the pump may pump coolant (or cooling water) into a coolant inlet 135 arranged at a bottom (relative to a surface on which the engine system, or vehicle, sits) of the EGR cooler. Coolant flows through a plurality of cooling tubes (as shown in FIGS. 2-4, described in greater detail below) within the EGR cooler. Coolant may then exit the EGR cooler via a coolant exit 137 arranged at a top of the EGR cooler (the top opposite the bottom of the EGR cooler). Thus, the EGR cooler may be filled with water (or coolant) from the bottom of the EGR cooler to the top via driving force from the pump. In some embodiments, the pump may then be arranged at a bottom of the EGR cooler. In this way, the EGR cooler may be filled with water or coolant through the bottom, thereby pushing air through and out the top of the EGR cooler. Thus, coolant may fill and flow through the cooling tubes in a direction opposite that of gravity. Further, there may be one or more additional sensors coupled to the coolant inlet and coolant exit of the EGR cooler for measuring a temperature of the coolant entering and exiting the EGR cooler.

The rail vehicle further includes the controller (e.g., engine controller) to control various components related to the rail vehicle. As an example, various components of the vehicle system may be coupled to the controller via a communication channel or data bus. In one example, the controller includes a computer control system. The controller may additionally or alternatively include a memory holding non-transitory computer readable storage media (not shown) including code for enabling on-board monitoring and control of rail vehicle operation. In some examples, the controller may include more than one controller each in communication with one another, such as a first controller to control the engine and a second controller to control other operating parameters of the locomotive (such as tractive motor load, blower speed, etc.). The first controller may be configured to control various actuators based on output received from the second controller and/or the second controller may be configured to control various actuators based on output received from the first controller.

The controller may receive information from a plurality of sensors and may send control signals to a plurality of actuators. The controller, while overseeing control and management of the engine and/or rail vehicle, may be configured to receive signals from a variety of engine sensors, as further elaborated herein, in order to determine operating parameters and operating conditions, and correspondingly adjust various engine actuators to control operation of the engine and/or rail vehicle. For example, the engine controller may receive signals from various engine sensors including, but not limited to, engine speed, engine load, intake manifold air pressure, boost pressure, exhaust pressure, ambient pressure, ambient temperature, exhaust temperature, particulate filter temperature, particulate filter back pressure, engine coolant pressure, gas temperature in the EGR cooler, or the like. The controller may also receive a signal of an amount of water in the exhaust from an exhaust oxygen sensor 162. Additional sensors, such as coolant temperature sensors, may be positioned in the cooling system. Correspondingly, the controller may control the engine and/or the rail vehicle by sending commands to various components such as the traction motors, the alternator/generator, fuel injectors, valves, or the like. For example, the controller may control the operation of a restrictive element (e.g., such as a valve) in the engine cooling system. Other actuators may be coupled to various locations in the rail vehicle.

With reference to FIGS. 2-4, an EGR cooler 200 is shown. The EGR cooler may be positioned in an engine system, such as the engine system shown in FIG. 1. The EGR cooler shown in FIGS. 2-4 may be the EGR cooler 134 shown in FIG. 1. FIG. 2 shows an exterior side view of the EGR cooler with cooling tube ends exposed. FIG. 3 shows a cross-sectional front view of the EGR cooler viewing the cooler from an exhaust inlet of the EGR cooler and thus a first row of cooling tubes positioned proximate to the exhaust inlet are shown. FIG. 4 shows a cross-sectional side view of the EGR cooler taken along a mid-section of the EGR cooler. FIGS. 2-4 include an axis system 201 including a vertical axis 205, horizontal axis 207, and lateral axis 203. Further, the EGR cooler includes a central axis 220.

The EGR cooler includes a housing (e.g., outer housing) 202, and a plurality of cooling tubes 204 disposed within the housing. The cooling tubes allow coolant to flow therethrough and exchange heat with exhaust gas that flows through an interior of the housing, outside of the cooling tubes (e.g., outside of exterior walls of the cooling tubes). As shown at 212, hot exhaust gas flows into the housing of the EGR cooler through an inlet (e.g., exhaust inlet) 206 and then expands within an inlet manifold 226 before entering a body 232 of the EGR cooler which contains the cooling tubes. After passing through the body and flowing around the cooling tubes, the exhaust gas flows through an outlet manifold 228, and then finally exits the EGR cooler out through an outlet (e.g., exhaust outlet) 208, as shown at 214.

As shown in FIG. 2, the cooling tubes are arranged in a plurality of bundle groups (e.g., sections) 216 that may each include a plurality of bundles of cooling tubes. In this way, each bundle group includes an array of cooling tubes. An exterior baffle 218 is positioned between each bundle group and extends around an entire outer perimeter of the housing. The exhaust flowing through the body of the EGR cooler is hottest proximate to the inlet and inlet manifold (e.g., since the exhaust gas not been cooled much yet from passing over the cooling tubes). Thus, the cooling tubes closest to the inlet and inlet manifold (relative to cooling tubes in the middle or closer to the outlet of the EGR cooler) and closest to interior sidewalls 224 of the housing of the EGR cooler (e.g., closer than the cooling tubes proximate to the central axis of the EGR cooler) may experience increased thermal stress. Specifically, these cooling tubes may expand due to the hotter exhaust gas flowing around them from the EGR cooler inlet. However, since these cooling tubes are positioned adjacent to the internal sidewalls of the EGR cooler housing, they may not have enough room to expand and, as a result, may experience structural buckling and degradation. As a result, the cooling tubes may degrade and result in coolant leaks and/or reduced cooling of the exhaust gas flowing through the EGR cooler. Further, thermal expansion and compressive forces toward the cooling tubes from a tube sheet may result in degradation of coupling between the tube and tube sheet.

To overcome these issues, the leading cooling tubes of the EGR cooler that are positioned closest to the inlet and adjacent to the interior sidewalls of the housing (relative to the rest of the cooling tubes closer to the central axis of the EGR cooler and/or arranged more downstream in the EGR cooler, relative to the flow path of exhaust gas through the EGR cooler) may be removed from the EGR cooler and replaced by one or more interior baffles 210, as shown in FIGS. 2 and 3. In another example, as explained further below with reference to FIGS. 3 and 4, the above-described issues may additionally or alternatively be addressed by adding a compliant region to one or more cooling tubes of the leading cooling tubes that are positioned in a region of the EGR cooler closest to the inlet relative to more downstream cooling tubes within the EGR cooler.

As shown in FIG. 2, the EGR cooler includes two interior baffles positioned proximate to the inlet manifold, within a first bundle group (e.g., section) 234 of the EGR cooler. The first bundle group is positioned between the inlet manifold and a first exterior baffle of the EGR cooler (e.g., the exterior baffle closest to the inlet relative to the other exterior baffles of the EGR cooler). Specifically, in the first bundle group, the leading cooling tubes closest to the interior sidewalls, on both sides of the EGR cooler (e.g., sides opposite one another across the central axis and that run along a length of the cooling tubes, in a direction of the horizontal axis and a direction of flow through the cooling tubes), are removed from the bundle group and the interior baffles are arranged in their place. As shown in FIGS. 2 and 3, each interior baffle is a C-channel (extruded into the page in FIG. 2, in a direction of the horizontal axis). The ends of the walls of the C-channel of the interior baffles (e.g., ends of the "C") are directly coupled (e.g., via welding) to the interior sidewalls of the EGR cooler housing.

Additionally, each interior baffle has a width, in a direction of the vertical axis, which extends from a respective interior sidewall of the EGR cooler housing to the remaining cooling tubes of the first bundle group that are closest to the interior sidewall. As shown in FIG. 2, an outer edge of the baffle that faces the cooling tubes within the first bundle group extends to line 240 from the interior sidewall. In the region of the interior baffles, in the first bundle group, there are no cooling tubes between line 240 and the sidewall. However, in the bundle groups behind and downstream from the first bundle groups, in a direction of exhaust gas flow through the EGR cooler, there are cooling tubes in this region (between line 240 and the sidewall). In this way, cooling tubes are positioned behind, in a direction of exhaust gas flow, outer edges of the baffles, within bundle groups adjacent to the first bundle group. For example, a second bundle group positioned adjacent to and downstream from the first bundle group includes cooling tubes between the line 240 that is in-line with the outer edge of the baffle and the interior sidewall of the housing.

As also shown in FIG. 2, a first baffle of the two interior baffles is positioned between a first sidewall of the housing and the cooling tubes in the first bundle group and a second baffle of the two interior baffles is positioned between a second sidewall of the housing and the cooling tubes in the first bundle group. Edges of the first baffle and second baffle are positioned forward of the second bundle group relative to the exhaust inlet. Further, a width of each bundle group may be defined between an outermost tube of the bundle group on a first side of the bundle group and an outermost tube of the bundle group on a second side of the bundle group, the second side opposite the first side. As such, a width of the first bundle group including the interior baffles is narrower than a width of the second bundle group since the outermost cooling tubes within the second bundle group extend all the way to the sidewalls of the housing of the EGR cooler.

A front face of the interior baffle, arranged in a plane of the horizontal and vertical axis, as shown in FIG. 3, blocks exhaust gas from flowing through the portion of the first bundle without cooling tubes. The interior baffles guide exhaust gas flow through the remaining cooling tubes of the EGR cooler. This arrangement allows for the expansion of exhaust gas prior to contacting the first (e.g., nearest to the inlet) of the cooling tubes within the EGR cooler. The interior baffles reduce impact, erosion, and buckling on the remaining lead cooling tubes in the first bundle group. Alternatively, in another embodiment, instead of removing the leading cooling tubes closest to the internal sidewalls of the EGR cooler housing, these cooling tubes may instead be made of heavier gage material than those cooling tubes that are distal from the inlet and interior sidewalls. In one embodiment, cooling tubes of different composition and/or size/thickness are proximate the inlet. The composition is selected from those having relatively higher erosion resistance, and thermal fatigue and thermal stress resistance than the material of the other cooling tubes. In yet another example, as explained further below with reference to FIGS. 3 and 4, one or more of the leading cooling tubes within the first bundle group closest to the exhaust inlet of the EGR cooler may include a compliant region (e.g., including a plurality of corrugations). However, cooling tubes in bundle groups downstream of the first bundle group, or downstream of a most downstream cooling tube including the compliant region, may not include a compliant region. In this way, only cooling tubes subject to a higher level of thermal stress (e.g., proximate to the inlet) may include a compliant region.

As shown in FIG. 2, only the first bundle group includes the interior baffle and no other bundle groups (other than the first bundle group closest to the inlet of the EGR cooler) include an interior baffle at the interior sidewalls of the housing of the EGR cooler. Instead, the other bundle groups have cooling tubes positioned adjacent to and at the interior sidewalls of the housing of the EGR cooler.

As seen in FIGS. 2-4, for each bundle group, ends of the cooling tubes are arranged at a tube sheet 222. For example, there may be a first tube sheet for a first end of each cooling tube within one bundle group and a second tube sheet for an opposite, second end of each cooling tube within the one bundle group. Each tube sheet extends across the EGR cooler, in a direction of the vertical axis, between opposite interior sidewalls of the housing. Each tube sheet also extends in a direction of the lateral axis, between two adjacent exterior baffles (or between an exterior baffle and the inlet manifold or outlet manifold of the EGR cooler, in the case of the outermost bundle groups). In one embodiment, for each bundle group, ends of the cooling tubes within that bundle group may be welded to the corresponding tubes sheet via entry welds. As indicated at 230 in FIG. 2, the entry welds are circumferential welds around a circumference of each cooling tube that connect each cooling tube end to the corresponding tube sheet. As shown in FIG. 2, the entry welds on the side tubes that are replaced by the interior baffles may be eliminated in order to remove the identified tubes and include the above-described interior baffle.

In an alternate embodiment, the cooling tubes may be rolled into the corresponding tube sheet instead of welded. In this embodiment, each cooling tube may be mechanically expanded into the tube sheet.

The tube sheets are coupled at a first end (e.g., sidewall) of the tube sheet to a first sidewall of the housing and at a second end (e.g., sidewall) of the tube sheet to a second sidewall of the housing, the second sidewall opposite the first sidewall across the central axis of the EGR cooler housing.

As introduced above, one or more cooling tubes within a region of the EGR cooler closest to the exhaust inlet of the EGR cooler (such as in the first bundle group shown in FIG. 2) may include a compliant region. The compliant region may allow the cooling tube to expand (e.g., due to thermal gradients) without causing degradation to the cooling tube or tube-tube sheet connection (e.g., degradation of the weld connection between the end of the cooling tube and the tube sheet that it is directly coupled to). Further, the compliant region may be positioned at an end of the cooling tube, inward of where the cooling tube end couples with the tube sheet. FIGS. 3 and 4 show one or more cooling tubes having such a compliant region.

Turning first to FIG. 3, a cross-sectional front view of the EGR cooler 200 is shown. The end view shown in FIG. 3 is from an inlet end of the EGR cooler. Thus, the cooling tubes shown may be a first row of leading cooling tubes that are closest to the exhaust inlet of the EGR cooler relative to all other downstream rows of cooling tubes within the EGR cooler. As shown in FIG. 3, the EGR cooler includes a plurality of cooling tubes 204 arranged across the EGR cooler and internal baffles 210 on opposite sides of the EGR cooler (replacing a portion of the leading cooling tubes). As shown in FIG. 3, each cooling tube (in the first row of cooling tubes) includes a compliant region 306 at a first end 308 and second end 310 of the cooling tube. In this way, each cooling tube shown in FIG. 3 includes a compliant region at both ends of the cooling tube. In alternate embodiments, each cooling tube in a region of cooling tubes including a compliant region may only include one compliant region at only one end of the cooling tube.

As shown in FIG. 3, each compliant region is positioned at one of the two ends of the cooling tube, at a location inward of a junction 312 where the cooling tube end couples to a corresponding tube sheet 222. For example, the compliant region is positioned inward of the tube-tube sheet junction relative to a central axis, or interior, of the EGR cooler. This positioning allows the cooling tube to expand via the compliant (e.g., flexible) nature of the compliant region at ends of the cooling tube without degrading the tube-tube sheet connection or cooling tubes themselves. For example, compression forces experienced by the cooling tube ends from the tube sheet may be absorbed by the compliant regions. Each compliant region may thus provide flex in that section of the cooling tube and may include a plurality of spring-like elements that increase the compliance of the compliant region. In one example, as shown in FIG. 3, each compliant region may include a plurality of corrugations (e.g., bellows) 314. Each corrugation may extend outward from an outer surface of the cooling tube. In this way, the corrugations of the compliant region (e.g., corrugated region) may have a larger diameter than the tube diameter of the cooling tube (e.g., the diameter of the cooling tube all the way along a length of the cooling tube). However, an inner tube diameter through which coolant flows may remain the same along a length of the cooling tube. In other examples, the compliant region may include a plurality of alternate compliant elements such as springs. In another example, each corrugation may extend inward, toward a central axis of the cooling tube. As a result, the corrugations of the compliant region may have an outer diameter that is substantially the same as the outer diameter of the cooling tube and an inner diameter of the corrugations may have a smaller diameter than the outer diameter of the cooling tube. The material of the compliant region may be the same as the material of a remainder of the cooling tube. Additionally, in some examples, the compliant region may be continuous and formed as one piece with a remainder of the cooling tube.

In one example, each compliant region may have a length in a range of approximately 15 to 20 mm and each cooling tube may have a length in a range of 350 to 380 mm. For example, each cooling tube may have a length of approximately 370 mm and each compliant region may have a length of 16 mm. In yet another example, each compliant region may have a number of corrugations in a range of five to fifteen. In yet another example, each compliant region may have 7 corrugations. Further, each compliant region may have a stiffness in a range of 950-1050 N/mm. The stiffness of each compliant region may differ based on the positioning of the cooling tube within the EGR cooler to which they belong, as explained further below with reference to FIG. 4. In this way, the compliant region of the cooling tube may have a greater compliance that a portion of the cooling tube that does not have a compliant region (e.g., in a middle portion of the cooling tube).

The EGR cooler also includes a plurality of gas passages 302 through which exhaust gas flows. The gas passages are arranged between the cooling tubes and include fins 304 which increase the cross-sectional area for heat transfer between the exhaust gas and cooling tubes. Each fin extends between two adjacent cooling tubes. As shown in FIG. 3 and FIG. 4, a first plurality of fins 316 extend along a length of each cooling tube of the cooling tubes including the compliant region, from an inward end (relative to a center of the EGR cooler) of a first compliant region 318 to an inward end of a second compliant region 320 of the cooling tubes. In this way, no cooling fins may be coupled to or positioned proximate to the compliant regions of the cooling tubes having the compliant regions. In contrast, as shown in FIG. 4, a second plurality of fins 402 extend along an entire length of each cooling tube that does not including a compliant region.

Continuing with FIG. 4, the cross-sectional side view of the EGR cooler 200 shows a section of a plurality of cooling tubes 204 extending along a length of the EGR cooler from the exhaust inlet 206 to the exhaust outlet 208. The direction of exhaust flow into and out of the EGR cooler is shown by arrows 404. All the cooling tubes of the EGR cooler are shown at 406. As explained previously, only a portion (first portion 408) of all the cooling tubes may include a compliant region 306. The first portion of cooling tubes having the compliant region is positioned proximate to the exhaust inlet. Said another way, the first portion of cooling tubes having the compliant region is positioned closer to the exhaust inlet than the remainder of cooling tubes in the EGR cooler. As such, all the cooling tubes of the EGR cooler may include a second portion 410 of cooling tubes, downstream of the first portion (in a direction of exhaust flow through the EGR cooler), where none of the cooling tubes within the second portion include a compliant region. In another embodiment, not all cooling tubes within the first portion may include a compliant region or a compliant region on both ends of the cooling tube. For example, the first portion of cooling tubes may include one or more cooling tubes having at least one compliant region. However, the second portion of cooling tubes not having any cooling tubes with a compliant region is positioned downstream of a most downstream cooling tube having a compliant region within the first portion of cooling tubes.

In some embodiments, the first portion of cooling tubes may be positioned within the first bundle group 234 shown in FIG. 2. In another example, the first portion of cooling tubes that include one or more tubes with a compliant region may be only a more upstream portion of the first bundle group. In yet another example, the first portion of cooling tubes that include one or more tubes with a compliant region may include the first bundle group and a portion or all of a second bundle group directly downstream of the first bundle group.

Additionally, as shown in FIG. 4 and introduced above, the cooling tubes within the first portion of cooling tubes having one or more tubes with a compliant region may have varying compliance (e.g., compliant regions with different numbers of corrugations or bellows). For example, the cooling tube (or tubes) closest to the exhaust inlet within the first portion of cooling tubes may have compliant regions with the greatest compliance (e.g., greatest number of corrugations or bellows). As shown in FIG. 4, the first few cooling tubes closest to the exhaust inlet include compliant regions with two corrugations each. However, a less compliant cooling tube 412, downstream of the first few cooling tubes, has compliant regions with one corrugation each. In this way, the compliance of the compliant regions may decrease as the cooling tubes to which they belong are positioned farther away from the exhaust inlet (and toward the exhaust outlet). In another embodiment, all or most of the cooling tubes of the EGR cooler may include a compliant region where the compliance of the compliant regions decrease from a position of a cooling tube proximate to the exhaust inlet to a position of a cooling tube proximate to the exhaust outlet. In this way, the cooling tubes may have compliant regions of varying compliance throughout the EGR cooler or within the first portion of cooling tubes.

During manufacturing of the EGR cooler, the cooling tubes and fins may be positioned within the EGR cooler. However, the cooling tubes and fins may initially be positioned within the EGR cooler such that a space (or gap) exists between an outer surface of a cooling tube and fins surrounding the cooling tubes. After installation, the cooling tubes are expanded (e.g., the outer diameter of the cooling tubes is increases) to meet and be positioned against fins within the adjacent exhaust gas passages. This allows for increased heat transfer between coolant flowing within the cooling tubes and exhaust gas passing over the fins when the EGR cooler is in use. As described above, fins may not be positioned in an area of the cooling tube including the compliant region. However, it may also be undesirable to expand the compliant region during the tube expansion process. Thus, a special tool, such as an expanding mandrel, may be used to expand only the diameter of the portion of the cooling tube not including the compliant region. A schematic illustration of the process for expanding cooling tubes within an EGR cooler including a portion of cooling tubes including a compliant region is shown in FIG. 5. Additionally, FIG. 6 depicts a corresponding method for expanding cooling tubes within the EGR cooler.

Turning first to FIG. 5, a first schematic 502 shows a portion of a cooling tube 204 of an EGR cooler (such as EGR cooler 200 shown in FIGS. 2-4) that includes a compliant region 306. The portion of the cooling tube not having the compliant region has an outer diameter 506. Further, the first schematic shows the cooling tube before going through the expansion process and thus an outer surface 505 of the cooling tube is spaced away from adjacent rows of fins 304. An expanding mandrel 508 may be used for expanding the outer diameter of the cooling tube. The expanding mandrel includes one or more expansion sections 510 which are configured to expand outward from a body of the expanding mandrel, relative to a central axis of the expanding mandrel. In the first schematic the expansion sections of the expanding mandrel are retracted so that an outermost diameter 511 of the expanding mandrel is smaller than the outer diameter of the cooling tube. In this way, the expanding mandrel may pass through the cooling tube, past the compliant region, without expanding the cooling tube in the region of the compliant region.

FIG. 5 also shows a second schematic 504 where the expansion sections of the expanding mandrel have been actuated and expanded outward from the central axis of the expanding mandrel. The expanded outermost diameter 513 of the expanding mandrel, in its expanded configuration, is greater than the original outer diameter 506 of the cooling tube shown in the first schematic. As a result, when the expanded expanding mandrel passes through the portion of the cooling tube not including the compliant region, the outer diameter of the cooling tube increases to an expanded outer diameter 512 (which may be substantially the same as the expanded outermost diameter of the expanding mandrel). As a result, the outer surface of the cooling tube, in the region without the compliant region, is in direct contact with the adjacent rows of fins and there is no longer a gap between the cooling tube and adjacent rows of fins. Further, an end 514 of the cooling tube, outward of the compliant region, may be the end of the cooling tube that couples with a corresponding tube sheet. As such, this end may also not be expanded by the expanding mandrel. In this way, the cooling tubes may be expanded to connect the cooling tubes with adjacent rows of fins without expanding the compliant region of the cooling tubes.

Figure 6:
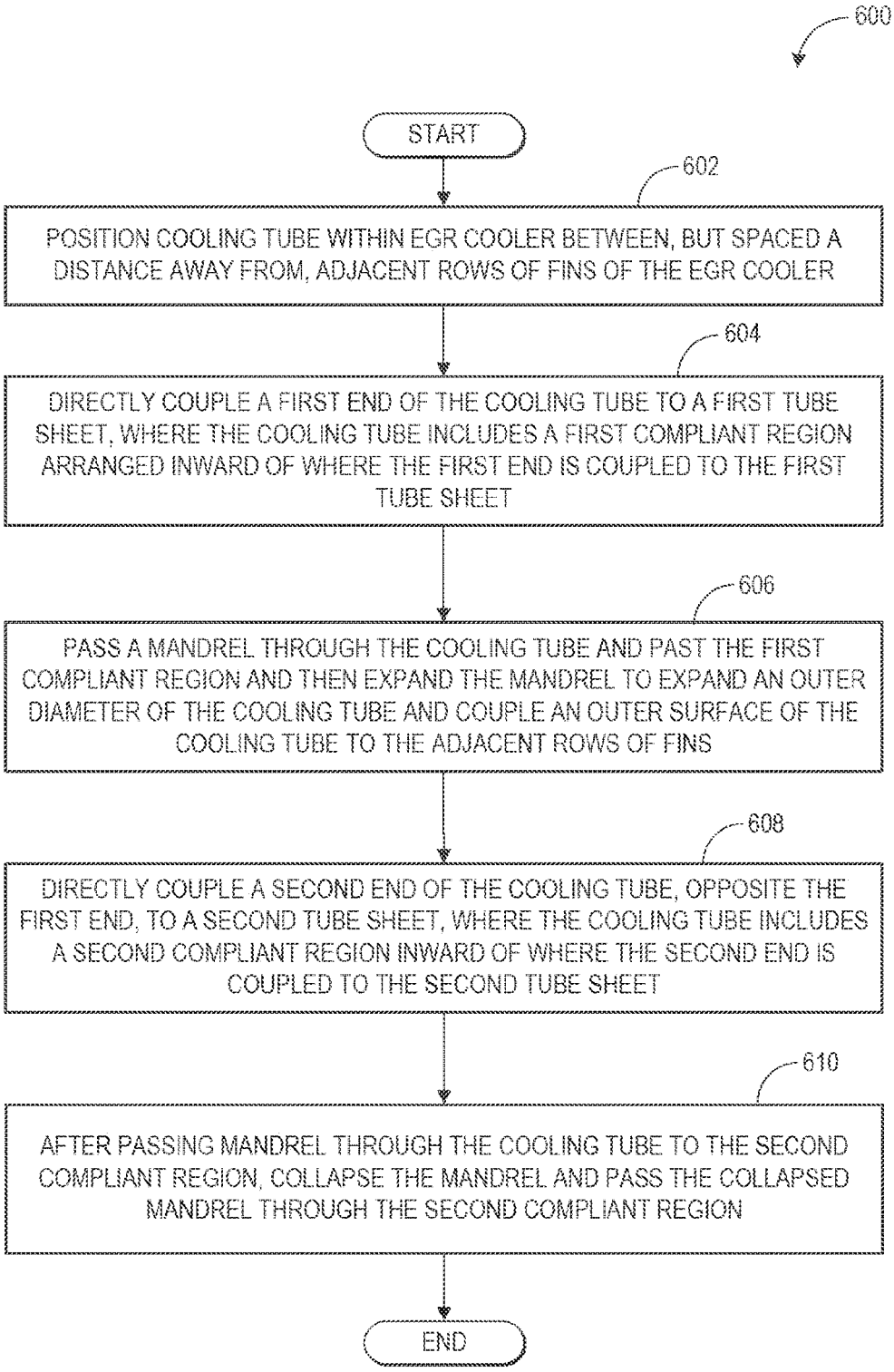
FIG. 6 shows a method for expanding cooling tubes within an EGR cooler according to an embodiment of the invention.

Turning to FIG. 6, a method 600 is presented for expanding cooling tubes within the EGR cooler. At 602, the method includes positioning a cooling tube within the EGR cooler between, but spaced a distance away from, adjacent rows of fins of the EGR cooler. At 604, the method includes directly coupling a first end of the cooling tube to a first tube sheet (such as tube sheet 222 shown in FIGS. 2-4), where the cooling tube includes a first compliant region arranged inward of where the first end is coupled to the first tube sheet. At 606, the method includes passing a mandrel through the cooling tube and past the first compliant region and then expanding the mandrel to expand an outer diameter of the cooling tube and couple an outer surface of the cooling tube to the adjacent rows of fins (as shown in the second schematic 504 in FIG. 5). In one example, expanding the mandrel includes increasing an outer diameter of the mandrel in a central region of the cooling tube, between the first compliant region and second compliant region. At 608, the method includes directly coupling a second end of the cooling tube, opposite the first end, to a second tube sheet, where the cooling tube includes a second compliant region inward of where the second end is coupled to the second tube sheet. At 610, the method includes, after passing the mandrel through the cooling tube to the second compliant region, collapsing the mandrel and passing the mandrel through the second compliant region. In an alternate embodiment, the method at 610 may include, after passing the mandrel through the cooling tube to the second compliant region, collapsing the mandrel, and re-passing the mandrel through the cooling tube and out past the first compliant region to remove the mandrel from the cooling tube.

FIGS. 2-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As one embodiment, an exhaust gas recirculation (EGR) cooler, comprises a plurality of cooling tubes positioned within a housing of the EGR cooler, each cooling tube of the plurality of cooling tubes extending between and directly coupled to tube sheets of the EGR cooler at ends of each cooling tube, where at least one end of one or more cooling tubes of a first portion of the plurality of cooling tubes, inward of a tube sheet coupled to the at least one end, includes a compliant region, where the first portion is positioned proximate to an exhaust inlet of the EGR cooler. In a first example of the EGR cooler, a second portion of the plurality of cooling tubes, downstream of the first portion of the plurality of cooling tubes, do not include a compliant region and the EGR cooler further comprises a baffle positioned proximate to the exhaust inlet, between the first portion of the plurality of cooling tubes and a sidewall of the EGR cooler. In a second example of the EGR cooler, the compliant regions includes a plurality of corrugations and is shaped to enable expansion of the tube sheets toward and away from one another. Each corrugation of the plurality of corrugations extends outwardly from an outer tube diameter of a corresponding cooling tube. In one example, the plurality of corrugations includes a number in a range of five to fifteen. In another example, a number of the plurality of corrugations of the one or more cooling tubes of the first portion is greatest at a most upstream cooling tube of the one or more cooling tubes and smallest at a most downstream cooling tube of the one or more cooling tubes. In a third example of the EGR cooler, the compliant region of the one or more cooling tubes is positioned inward of the tube sheet coupled to the at least one end, relative to a central axis of the EGR cooler. In a fourth example of the EGR cooler, a second portion of the plurality of cooling tubes arranged downstream, relative to a flow of exhaust through the EGR cooler, of a most downstream cooling tube of the one or more cooling tubes of the first portion do not include a compliant region. In a fifth example of the EGR cooler, each tube sheet of the tube sheets forms a wall of a respective coolant manifold of the EGR cooler, where coolant contacts a first side of each tube sheet and exhaust gas contacts an opposite, second side of each tube sheet. In a sixth example of the EGR cooler, the compliant region has a length in a range of fifteen to twenty mm and each cooling tube has a length in a range of 350 to 380 mm. In a seventh example of the EGR cooler, both ends of each cooling tube of the one or more cooling tubes includes the compliant region. In an eighth example of the EGR cooler, the EGR cooler further comprises a first plurality of fins extending along a length of each cooling tube of the one or more cooling tubes, from an inward end of a first compliant region to an inward end of a second compliant region of the one or more cooling tubes. In one example, no fins of the first plurality of fins are coupled to the compliant region and the EGR cooler further comprises a second plurality of fins extending along an entire length of each cooling tube of the plurality of cooling tubes not including a compliant region.

As another embodiment, an exhaust gas recirculation (EGR) cooler comprises: a first tube sheet coupled to a first side of a housing of the EGR cooler; a second tube sheet coupled to an opposite, second side of the housing; a first cooling tube positioned proximate to an exhaust inlet of the EGR cooler and including a first end coupled to the first tube sheet and a second end coupled to the second tube sheet, where a portion of the cooling tube at the first end, inward of the first tube sheet relative to a central axis of the EGR cooler, and a portion of the cooling tube at the second end, inward of the second tube sheet, includes a corrugated region; and a second cooling tube positioned downstream of the first cooling tube, where the second cooling tube does not include a corrugated region. In a first example of the EGR cooler, the corrugated region includes a plurality of corrugations with an outer diameter greater than an outer tube diameter of the cooling tube. In a second example of the EGR cooler, the second cooling tube is positioned closer to an exhaust outlet of the EGR cooler than the first cooling tube and the EGR cooler further comprises a baffle positioned proximate to the exhaust inlet, between the first cooling tube and a sidewall of the EGR cooler, where the baffle is in a region of the EGR cooler including the first cooling tube and positioned upstream of the second cooling tube, relative to exhaust flow through the EGR cooler. In a third example of the EGR cooler, the EGR cooler further comprises a first coolant manifold coupled to an outer side of the first tube sheet and a second coolant manifold coupled to an outer side of the second tube sheet.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method of expanding cooling tubes within a cooler, comprising:

positioning a cooling tube within the cooler between, but spaced a distance away from, adjacent rows of fins of the cooler;

directly coupling a first end of the cooling tube to a first tube sheet, where the cooling tube includes a first compliant region arranged inward of where the first end is coupled to the first tube sheet; and passing a mandrel through the cooling tube and past the first compliant region and then expanding the mandrel to expand an outer diameter of the cooling tube and couple an outer surface of the cooling tube to the adjacent rows of fins.

2. The method of claim 1, further comprising directly coupling a second end of the cooling tube, opposite the first end, to a second tube sheet, where the cooling tube includes a second compliant region inward of where the second end is coupled to the second tube sheet.

3. The method of claim 2, wherein expanding the mandrel includes increasing an outer diameter of the mandrel in a central region of the cooling tube, between the first compliant region and the second compliant region.

4. The method of claim 2, further comprising, after passing the mandrel through the cooling tube to the second compliant region, collapsing the mandrel and passing the collapsed mandrel through the second compliant region.

5. The method of claim 2, further comprising, after passing the mandrel through the cooling tube to the second compliant region, collapsing the mandrel, and re-passing the mandrel through the cooling tube and out past the first compliant region to remove the mandrel from the cooling tube.

6. The method of claim 1, wherein the mandrel includes an expansion section configured to expand outward from a body of the mandrel, relative to a central axis of the mandrel.

7. The method of claim 6, wherein passing the mandrel through the cooling tube and past the first compliant region includes passing the mandrel, with the expansion section retracted, through the cooling tube and past the first compliant region and wherein expanding the mandrel to expand the outer diameter of the cooling tube and couple the outer surface of the cooling tube to the adjacent rows of fins includes actuating the expansion section of the mandrel to expand outward from the central axis to the adjacent rows of fins.

8. The method of claim 1, wherein upon expanding the mandrel to expand the outer diameter of the cooling tube and couple the outer surface of the cooling tube to the adjacent rows of fins, the outer surface of the cooling tube is in direct contact with the adjacent rows of fins with there no longer being a gap between the cooling tube and the adjacent rows of fins.

9. The method of claim 1, wherein the first compliant region includes a plurality of corrugations.

10. The method of claim 9, wherein each corrugation of the plurality of corrugations extends outward from the outer surface of the cooling tube, the first compliant region having a larger diameter than the outer diameter of the cooling tube prior to expanding the mandrel to expand the outer diameter of the cooling tube.

11. The method of claim 1, wherein the first compliant region includes a plurality of bellows.

12. The method of claim 1, further comprising positioning the cooling tube proximate to an exhaust inlet of the cooler.

13. The method of claim 1, wherein the first compliant region is continuous and formed as one piece with a remainder of the cooling tube.

14. The method of claim 1, wherein a second end of the cooling tube does not include a compliant region and further comprising directly coupling the second end of the cooling tube, opposite the first end, to a second tube sheet.

15. A method of expanding cooling tubes within a cooler, comprising:

positioning a cooling tube within the cooler between, but spaced a distance away from, adjacent rows of fins of the cooler so that a gap exists between an outer surface of the cooling tube and fins surrounding the cooling tube;

directly coupling a first end of the cooling tube to a first tube sheet, where the cooling tube includes a first compliant region arranged inward of where the first end is coupled to the first tube sheet and a central region not including the first compliant region; and expanding only an outer diameter of the central region of the cooling tube and coupling an outer surface of the cooling tube, in the central region, to the adjacent rows of fins without expanding the first compliant region of the cooling tube.

16. The method of claim 15, wherein expanding only the outer diameter of the central region of the cooling tube includes passing a mandrel through the cooling tube and past the first compliant region and then expanding an expansion section of the mandrel, outward from a body of the mandrel, relative to a central axis of the mandrel.

17. The method of claim 15, further comprising directly coupling a second end of the cooling tube, opposite the first end, to a second tube sheet, where the cooling tube includes a second compliant region inward of where the second end is coupled to the second tube sheet, the central region arranged between the first compliant region and the second compliant region.

18. The method of claim 17, wherein the first compliant region and the second compliant region each include a plurality of corrugations extending outward from the outer surface of the cooling tube.

19. The method of claim 15, wherein the cooling tube is a first cooling tube, further comprising positioning the first cooling tube proximate to an exhaust inlet of the cooler, and further comprising positioning a second cooling tube not including a compliant region downstream of the first cooling tube within the cooler.

20. A method of expanding cooling tubes within a cooler, comprising positioning a cooling tube within the cooler between, but spaced a distance away from, adjacent rows of fins of the cooler;

directly coupling a first end of the cooling tube to a first tube sheet, where the cooling tube includes a first compliant region arranged inward of where the first end is coupled to the first tube sheet;

passing a mandrel through the cooling tube and past the first compliant region and then expanding an expansion section of the mandrel to expand an outer diameter of the cooling tube and couple an outer surface of the cooling tube to the adjacent rows of fins, in a region of the cooling tube not including the first compliant region;

directly coupling a second end of the cooling tube, opposite the first end, to a second tube sheet, where the cooling tube includes a second compliant region inward of where the second end is coupled to the second tube sheet; and after passing the mandrel through the cooling tube to the second compliant region, collapsing the mandrel and then passing the collapsed mandrel through the second compliant region or re-passing the mandrel through the cooling tube and out past the first compliant region to remove the mandrel from the cooling tube.

* * * * *